US008952817B2

(12) United States Patent
Garner et al.

(10) Patent No.: US 8,952,817 B2
(45) Date of Patent: Feb. 10, 2015

(54) SECURITY PACKAGE

(76) Inventors: Glen Walter Garner, Toronto (CA); Sheila Maureen Barry, Toronto (CA)

( * ) Notice: Subject to any disclaimer, the term of this patent is extended or adjusted under 35 U.S.C. 154(b) by 830 days.

(21) Appl. No.: 13/078,767

(22) Filed: Apr. 1, 2011

(65) Prior Publication Data

US 2012/0248115 A1 Oct. 4, 2012

(51) Int. Cl.

| | |
|---|---|
| ***G08B 13/14*** | (2006.01) |
| ***B65D 55/02*** | (2006.01) |
| ***E05B 73/00*** | (2006.01) |
| ***B65D 75/36*** | (2006.01) |

(52) U.S. Cl.

CPC ..... *B65D 55/028* (2013.01); *E05B 73/0023* (2013.01); *B65D 75/366* (2013.01); *B65D 75/367* (2013.01); *B65D 2203/10* (2013.01); *B65D 2211/00* (2013.01)

USPC ..... 340/572.8; 340/572.1; 340/568.1; 206/308.2; 206/387.11; 206/1.5

(58) Field of Classification Search

USPC ..... 340/572.1, 572.9, 572.8, 568.1; 206/216, 454, 307, 470, 308.2, 701, 206/387.11, 1.5; 70/275, 277

See application file for complete search history.

(56) References Cited

U.S. PATENT DOCUMENTS

| | | | | |
|---|---|---|---|---|
| 4,119,239 | A | 10/1978 | Anderson | |
| 4,499,353 | A | 2/1985 | Shields | |
| 4,603,453 | A | 8/1986 | Yokoyama | |
| 4,739,883 | A | 4/1988 | Mohs et al. | |
| 5,426,419 | A | 6/1995 | Nguyen | |
| 5,944,173 | A | 8/1999 | Boire et al. | |
| 5,969,613 | A * | 10/1999 | Yeager et al. | 340/572.9 |
| 6,886,688 | B2 | 5/2005 | Sykes et al. | |
| 7,255,230 | B1 | 8/2007 | Appelbaum | |
| 2002/0023414 | A1 | 2/2002 | Aylward | |
| 2002/0134695 | A1 * | 9/2002 | Lafleur | 206/308.1 |
| 2003/0196918 | A1 * | 10/2003 | Lau | 206/308.2 |
| 2004/0010954 | A1 | 1/2004 | O'Brien et al. | |
| 2006/0087431 | A1 * | 4/2006 | Shieh et al. | 340/572.1 |

(Continued)

FOREIGN PATENT DOCUMENTS

| | | |
|---|---|---|
| FR | 2949967 | 3/2011 |
| GB | 2078677 | 1/1982 |

OTHER PUBLICATIONS

International Search Report (PCT/CA2012/050212) Completed Sep. 26, 2012. Dated Oct. 2, 2012.

*Primary Examiner* — Hoi Lau
(74) *Attorney, Agent, or Firm* — Hill & Schumacher

(57) ABSTRACT

Provided is a security package which generally comprises a casing for housing a product and a collar for locking the casing. The collar generally has a locked and unlocked configuration and comprises a first locking member having at least one male locking mechanism, and a second locking member having at least one female locking mechanism lockable to the at least one male locking mechanism. The casing generally has an open and closed configuration, and comprises a cavity shaped to substantially conform to the product. In the locked configuration the collar secures the casing in the closed configuration. The casing may comprise a first and second casing portion, and these may be integrally formed with the one or more of the first and second locking members. The collar may form a perimeter around the casing, may be adjustable, and may house a security device such as an RFID (radio-frequency identification) tag.

31 Claims, 13 Drawing Sheets

(56) References Cited

U.S. PATENT DOCUMENTS

| | | | | |
|---|---|---|---|---|
| 2006/0152371 | A1* | 7/2006 | Marsilio et al. | 340/572.9 |
| 2006/0174667 | A1 | 8/2006 | Garner | |
| 2006/0196780 | A1 | 9/2006 | Horngren | |
| 2010/0065460 | A1 | 3/2010 | Appelbaum | |
| 2010/0277288 | A1* | 11/2010 | Cheng | 340/10.42 |
| 2010/0294680 | A1* | 11/2010 | Mowery et al. | 206/308.2 |
| 2011/0113437 | A1* | 5/2011 | Day | 720/728 |
| 2012/0044628 | A1* | 2/2012 | Marriott | 361/679.33 |

* cited by examiner

SECURITY PACKAGE

FIELD OF THE INVENTION

The present invention is directed towards security packages for retail products and in particular security packages with locking collars and with casings which conform to contained retail products.

BACKGROUND

In retail stores, theft of merchandise is a difficult problem to tackle effectively. This problem is even more apparent in large stores with small items for sale, where it is infeasible to hire enough staff to monitor the entire store, and where patrons might easily conceal a small item in their clothing or in a bag. Some retailers have worked around this problem by putting small items in relatively large packages using the strategy that it will be more difficult to conceal the large package. However, consumers and manufacturers are becoming less comfortable with this solution because it generates a considerable amount of packaging waste. As well, even though the packaging may be relatively large it still may be relatively is to tamper with it and get at the product. Another problem with this solution is that it takes up a lot of shelf space as well as space during shipping to the retailer. Many retailers have strategically laid out their display shelving to maximize selling space. Any changes to that space causes further implementation problems and costs. It is also apparent that traditional larger security boxes take up extra space and if there is an item for sale that is not in the larger security box then that items is more likely to be stolen. A further problem with this solution is that it typically uses hard plastic boxes or something that is becoming seen as less environmentally friendly.

Some solutions to this problem are highlighted in the following paragraphs. For example, U.S. Pat. No. 6,886,688 describes a security package for enclosing DVD's and other articles for deterring the tampering with the shrink wrapped protecting the product or removing the product from the security package. The security package is made from inexpensive material and can be placed on the product at the factory. The security package is thin such that it fits in the display racks for the product and is made of a clear material such that a customer can see the packaging information on the package. The security package can be removed at the store with a special key, or when purchased the consumer may take the security package home with the product therein and remove the security package at home. The security package may be removed and reused at the store or sold with the product inside. Since the security package is inexpensive it may be disposed of rather than reused. This is also perceived as merely adding to the waste from an environmental perspective.

U.S. Publication No. 2006/0196780 describes an anti-theft box for protection of goods comprising a main body defining an inner space for the goods to be protected, a lid closing the main body, an alarm transmitter triggering a central alarm in case the anti-theft box passes an alarm gate, and a releasable lock locking the lid to the main body. The anti-theft box according to the invention also comprises an internal alarm circuit that is controlled to be fused when the releasable lock is in a locking position and defused when the releasable lock is in an unlocked position. The internal alarm circuit comprises a first switch, which in the fused state is arranged to trigger the alarm circuit to emit a sound signal in case the first switch indicates that the lid and the main body are separated.

U.S. Pat. No. 5,944,173 describes a security package for use in a retail setting having a pair of members hinged together that can be rotated about the hinge between an open and closed position. A lock is also provided to secure the two members in the closed position. A plurality of ribs are provided to reinforce the side walls of the two members and interlocks are provided on each member which cooperate to cover the edges of the side walls when the package is closed to prevent unauthorized opening of the package by prying apart the side walls.

U.S. Publication No. 2006/0174667 describes a security device including at least two pins and at least two locks. Each lock is adapted to releasably receive one pin. At least one of the at least two pins and the at least two locks are attached together. The device has a release position wherein the pins are not in the locks and has a locked position where the pins are secured in the locks. In another aspect of the invention there is provided a detacher for use with two locks.

SUMMARY

The present invention provides a security package for a product, comprising a casing having an open and a closed configuration and comprising at least one cavity shaped to receive the product; and a collar having a locked and an unlocked configuration, in the locked configuration the collar secures the casing in the closed configuration, the collar has a first locking member having at least one male locking mechanism, and a second locking member having at least one female locking mechanism lockable to the at least one male locking mechanism. In some embodiments, the casing may comprise a first casing portion, a second casing portion, and a connector connected between the first and second casing portion. The cavity is formed by one or both of the first and second casing portions. The connector may comprise a strip of foldable material, and the first casing portion, the second casing portion and the connector are made of one continuous piece of material. The casing may also comprise at least one hole shaped to allow a portion of the at least one male locking mechanism therethrough. The casing may be formed from one continuous piece of thermoforming plastic.

In some embodiments, the casing comprises a first casing portion, and a second casing portion, wherein the second casing portion is integrally formed with one of the first and second locking members.

In other embodiments, the casing further comprises a first casing portion, and a second casing portion, wherein the first casing portion is integrally formed with the first locking member, and the second casing portion is integrally formed with the second locking member.

The collar of the present invention may be shaped to form a perimeter around the cavity.

In another embodiment, the at least one male locking mechanism is a plurality of male locking mechanisms, the at least one female locking mechanism is a plurality of female locking mechanisms, and the male and female locking mechanisms are disposed in the first and second locking members in a pattern, wherein the collar transitions from the locked configuration to the unlocked configuration only when all of the locking mechanisms are unlocked simultaneously. In addition, the first and second locking members may be formed from an opaque material, wherein the first and second locking members substantially envelope the plurality of male locking mechanisms and the plurality of female locking mechanisms when the collar is in the locked configuration. This provides the retailer with a wide variety of options. For example a different type of lock may be used in the plurality of locks so that different type of detacher need to be in registration with the specific lock so that all of the locks can be released simultaneously to release the device.

In some embodiments of the invention, collar further comprises a metal wire, wherein the metal wire forms a perimeter around the cavity. The collar may also comprise at least one electronic security device, wherein the metal wire forms an antenna of the at least one electronic security device.

In other embodiments of the invention, the first and second locking members each comprise at least one member having an adjustable length.

Further, in some embodiments, the at least one male locking mechanism is a plurality of male locking mechanisms, a preselected number of the plurality of male locking mechanisms are lockable to corresponding female locking mechanisms in the second locking member, and the remaining number of the plurality of male locking mechanisms are insertable in at least one non-locking slot in the second locking member.

Further, in some embodiments, the at least one female locking mechanism is a plurality of female locking mechanisms, a preselected number of the plurality of female locking mechanisms are lockable to corresponding male locking mechanisms in the first locking member, and the remaining number of the plurality of female locking mechanisms are not locked. Further, the at least one male locking mechanism and the at least one female locking mechanism may comprise one or a combination of mechanical locking mechanisms and magnetic locking mechanisms.

The collar of the present invention may comprise at least one electronic security device. In such embodiments, the at least one electronic security device may be removable from the collar when the collar is in the unlocked configuration. Further, the at least one electronic security device may be one or a combination of RFID device and electronic article surveillance device. In some embodiments, the at least one electronic security device is an active device powered by a battery.

The at least one cavity may be a plurality of cavities shaped to receive a plurality of pieces of the product.

The casing may have a product information portion configured to receive product information. The product information portion may be a pocket. The casing may further include a third casing portion and the second and the third casing portion may have and open and closed configuration and in the closed configuration the second and third casing portions are the product information portion.

The collar may form a perimeter around the cavity and the collar may include a rigid portion and at least one flexible portion. The collar may include two flexible portions. The flexible portion may be a wire.

The casing may be provided by a manufacturer of the product and may be intended to stay with the product.

A security package for a product and a product package having an open and a closed configuration and comprising at least one cavity shaped to receive the product comprising a collar having a locked and an unlocked configuration, in the locked configuration the collar secures the product package in the closed configuration, the collar has a first locking member having at least one male locking mechanism, and a second locking member having at least one female locking mechanism lockable to the at least one male locking mechanism.

DETAILED DESCRIPTION

The systems described herein are directed, in general, to security packages for retail products and in particular security packages with locking collars and with casings which conform to contained retail products. Although embodiments of the present invention are disclosed herein, the disclosed embodiments are merely exemplary and it should be understood that the invention relates to many alternative forms, including different shapes and sizes. Furthermore, the Figures are not drawn to scale and some features may be exaggerated or minimized to show details of particular features while related elements may have been eliminated to prevent obscuring novel aspects. Therefore, specific structural and functional details disclosed herein are not to be interpreted as limiting but merely as a basis for the claims and as a representative basis for enabling someone skilled in the art to employ the present invention in a variety of manner. For purposes of instruction and not limitation, the illustrated embodiments are all directed to security packages with collars and casings which conform to contained retail products.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

As used herein, the terms "about" and "approximately", when used in conjunction with ranges of dimensions, compositions of mixtures or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

As used herein, the coordinating conjunction "and/or" is meant to be a selection between a logical disjunction and a logical conjunction of the adjacent words, phrases, or clauses. Specifically, the phrase "X and/or Y" is meant to be interpreted as "one or both of X and Y" wherein X and Y are any word, phrase, or clause.

Figure 1:
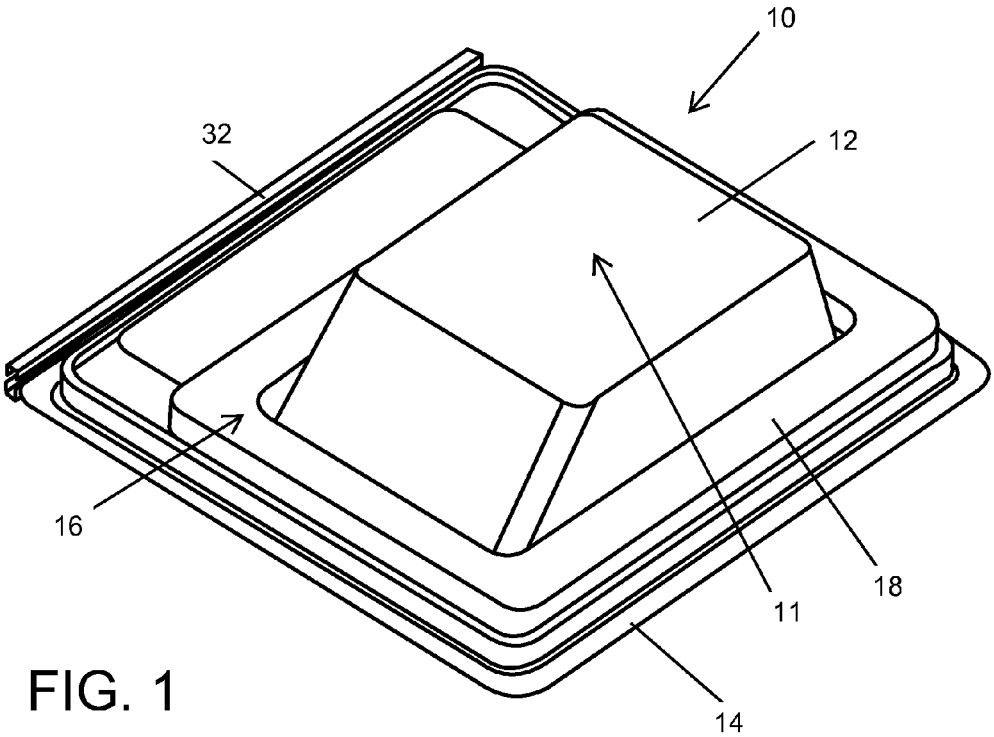
FIG. 1 is a perspective view of the front face of a security package enclosing a product, with the casing in the closed configuration and a collar in the locked configuration on the casing.
Figure 2:
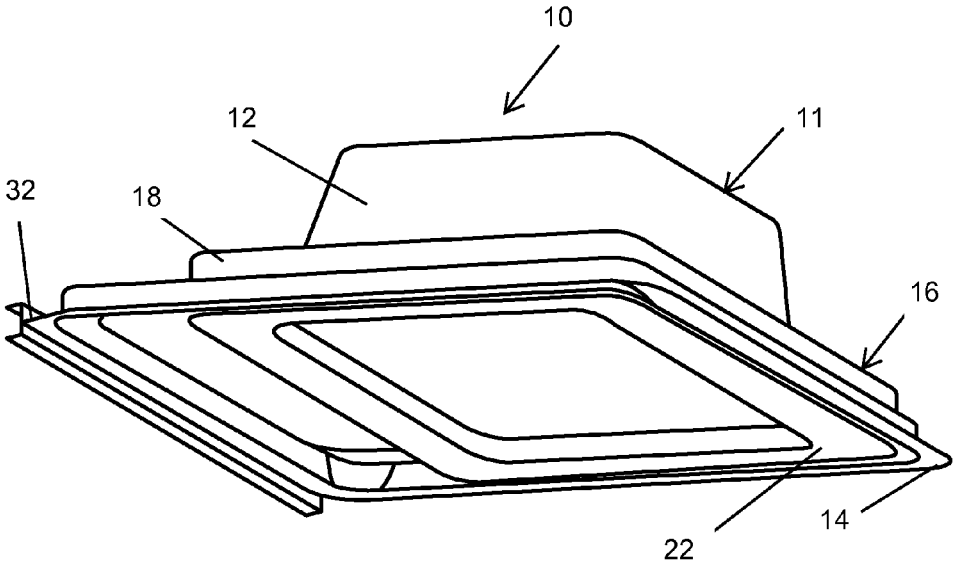
FIG. 2 is a perspective view of the back face of a security package of FIG. 1 enclosing a product, with the casing in the closed configuration and a collar in the locked configuration on the casing.

As shown in FIGS. 1 and 2, the security package 10 of the present invention generally comprises a casing 11 for housing a product and a collar 16 for locking the casing, thereby securing the product inside. The collar 16 generally has a locked and unlocked configuration and comprises a first locking member 18 having at least one male locking mechanism 20 (best seen in FIG. 5), and a second locking member 22 having at least one female locking mechanism 24 (best seen in FIG. 5) lockable to the at least one male locking mechanism 20. The casing 11 generally has an open and closed configuration, and comprises a cavity 12 shaped to substantially conform to the product. Further, in some embodiments of the invention, the casing 11 may comprise at least one hole 36 (best seen in FIG. 7) to allow the passage of male locking mechanism 20 components therethrough.

Figure 3:
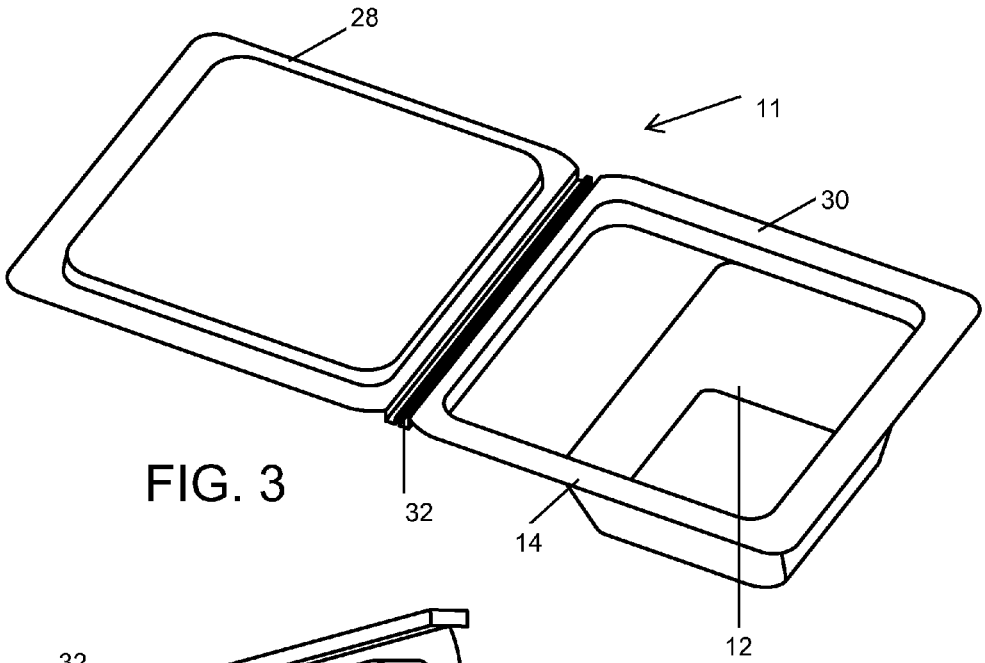
FIG. 3 is a perspective view of an alternate casing with a connector in its open configuration.
Figure 4:
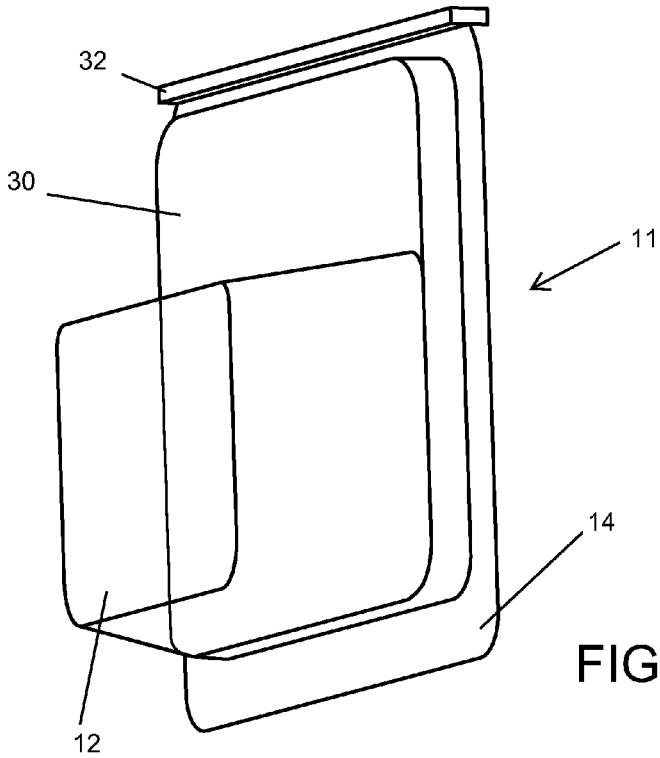
FIG. 4 is a perspective view of the casing of FIG. 3 with the connector in its closed configuration.
Figure 5:
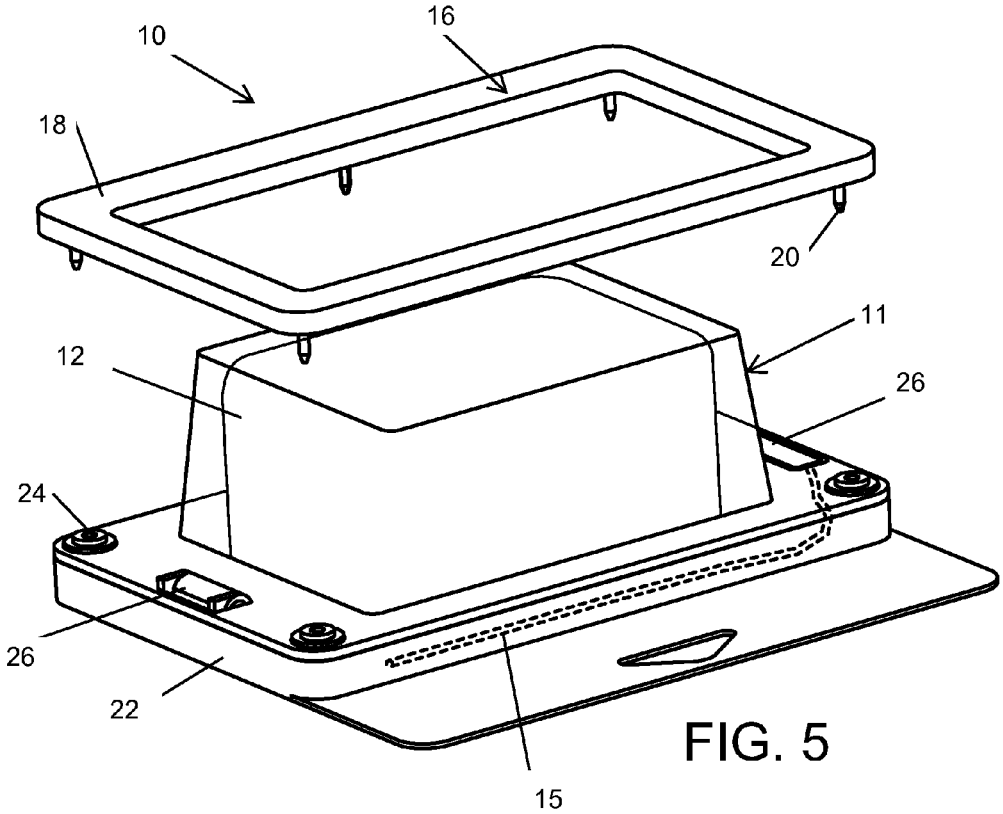
FIG. 5 is a perspective view of a security package with the second locking member integrally formed with the casing, and the collar in the unlocked configuration.
Figure 6:
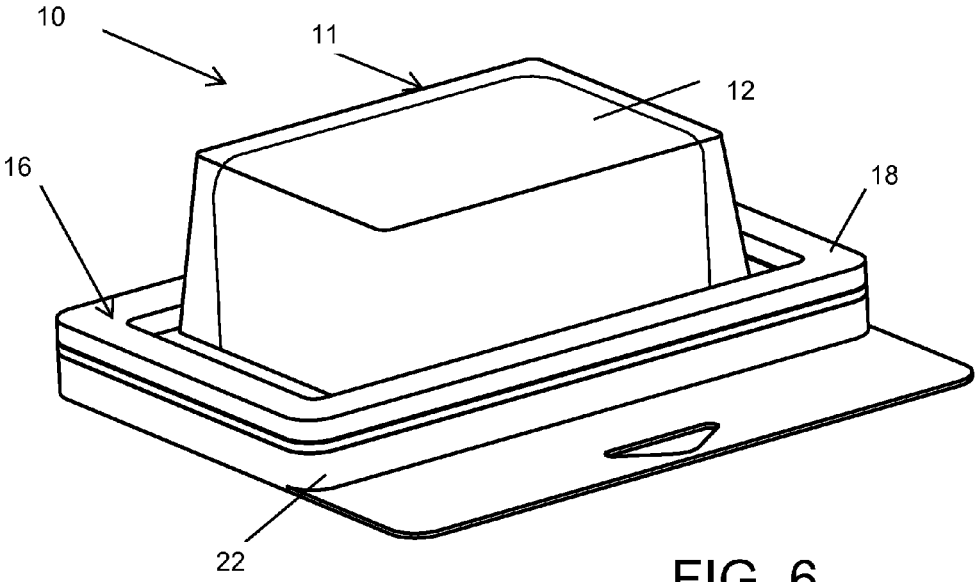
FIG. 6 is a perspective view of a security package of FIG. 5 with the second locking member integrally formed with the casing, and the collar in the locked configuration.

In many embodiments of the invention, the closed and open configurations of the casing 11 and the locked and unlocked configurations of the collar 16 are independent of one another. The open configuration of the casing 11 is any that allows a product to be placed in the cavity 12, while the closed configuration is any configuration suitable for accepting the collar 16 for locking the casing 11 in that configuration; these two configurations are shown in FIGS. 3 and 4. The collar 16 is in the locked or unlocked configuration when the at least one male and female locking mechanisms 20, 24 are locked or not locked to one another, respectively; these two configurations are shown in FIGS. 5 and 6. However, it should be appreciated that in some embodiments of the invention, the casing 11 and collar 16 are integrally formed such that the closed and open configurations of the casing 11 and the locked and unlocked configurations of the collar 16 are dependent on one another.

In one embodiment of the invention, the casing 11 comprises a first casing portion 28, a second casing portion 30, and a connector 32 connected between the first and second casing portions 28, 30, as shown in FIGS. 3 and 4. Thereby, when the first and second casing portions 28, 30 are rotated with respect to one another about this connector 32, the casing 11 can be transitioned between its closed and open configurations. In a embodiment, the connector 32 comprises a strip of foldable material. In another embodiment, the first casing portion 28, second casing portion 30 and connector 32 are integrally formed and made of one material. It should be appreciated that other types of connector 32, such as hinges, are possible for use in the present invention.

Figure 7:
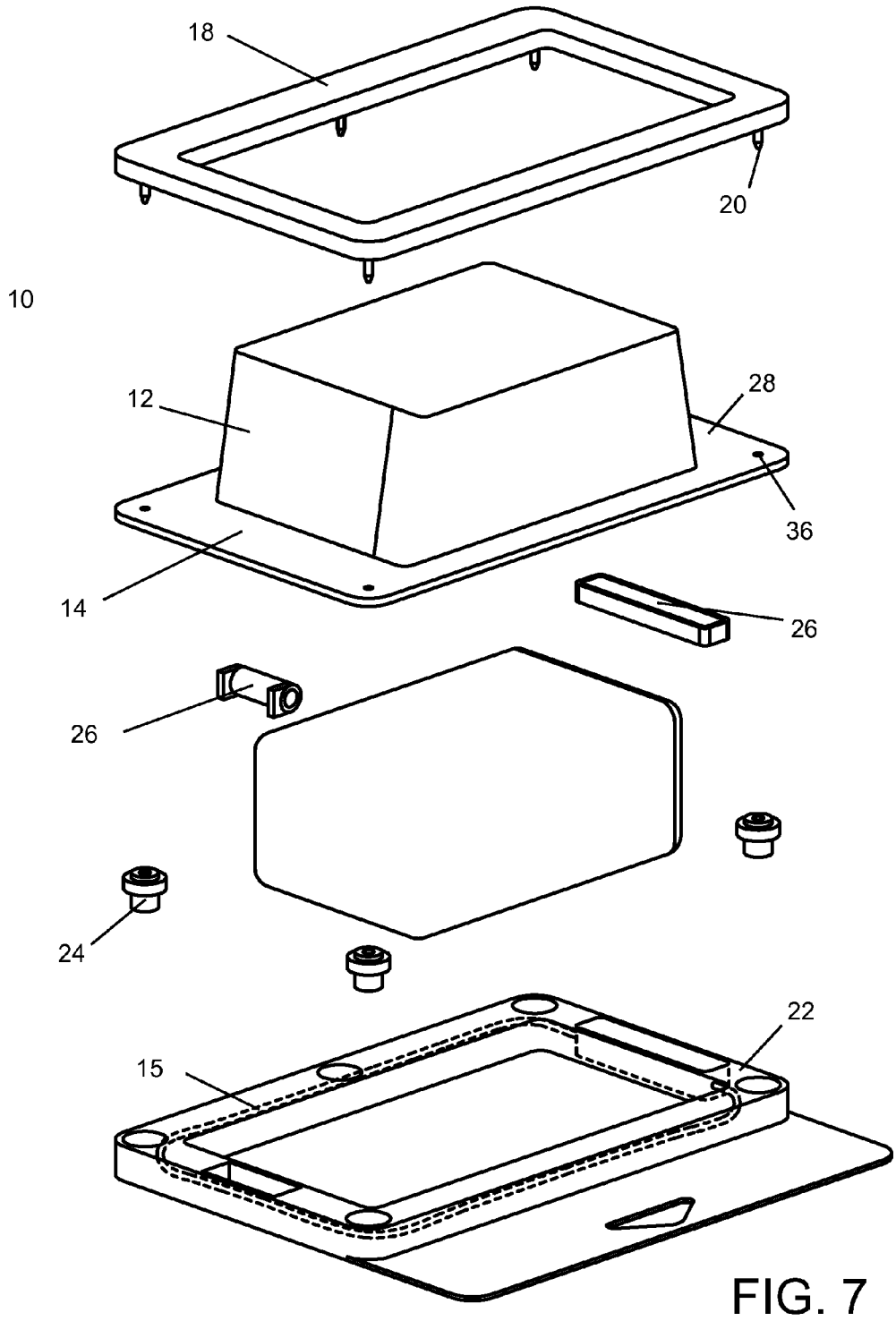
FIG. 7 is an exploded perspective view of a security package of FIG. 5 with the second locking member integrally formed with the casing.

In another embodiment of the invention, the casing 11 comprises a first casing portion 28, and a second casing portion 30, wherein the second casing portion 30 is integrally formed with one of the first and second locking members 18, 22 as shown in FIGS. 5, 6 and 7. In this embodiment, the casing 11 can be transitioned between its open and closed configuration by bringing the first casing portion 28 into and out of contact with whichever of the first and second locking members 18, 22 is integrally formed with the second casing portion 30.

Figure 8:
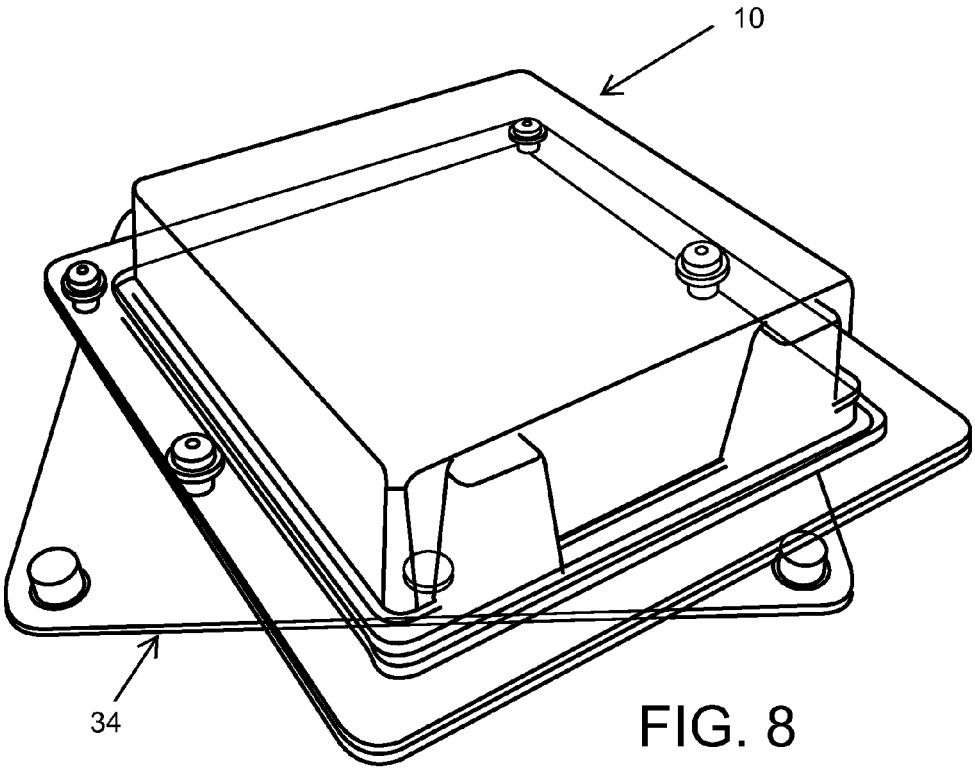
FIG. 8 is a frontal perspective view of a security package and a release tool.

In another embodiment of the invention, the casing 11 comprises a first casing portion 28, and a second casing portion 30, wherein the first casing portion 28 is integrally formed with the first locking member 18, and the second casing portion 30 is integrally formed with the second locking member 22, as shown in FIG. 8. This is an embodiment where the open and closed configurations of the casing 11 are dependent on the locked and unlocked configurations of the collar 16; by closing the casing 11, the at least one male and female locking mechanism 20, 24 engage each other. In this embodiment, the casing 11 can be transitioned between its open and closed configuration by bringing the first locking member 18 and second locking member 22 into contact with one another.

Figure 11:
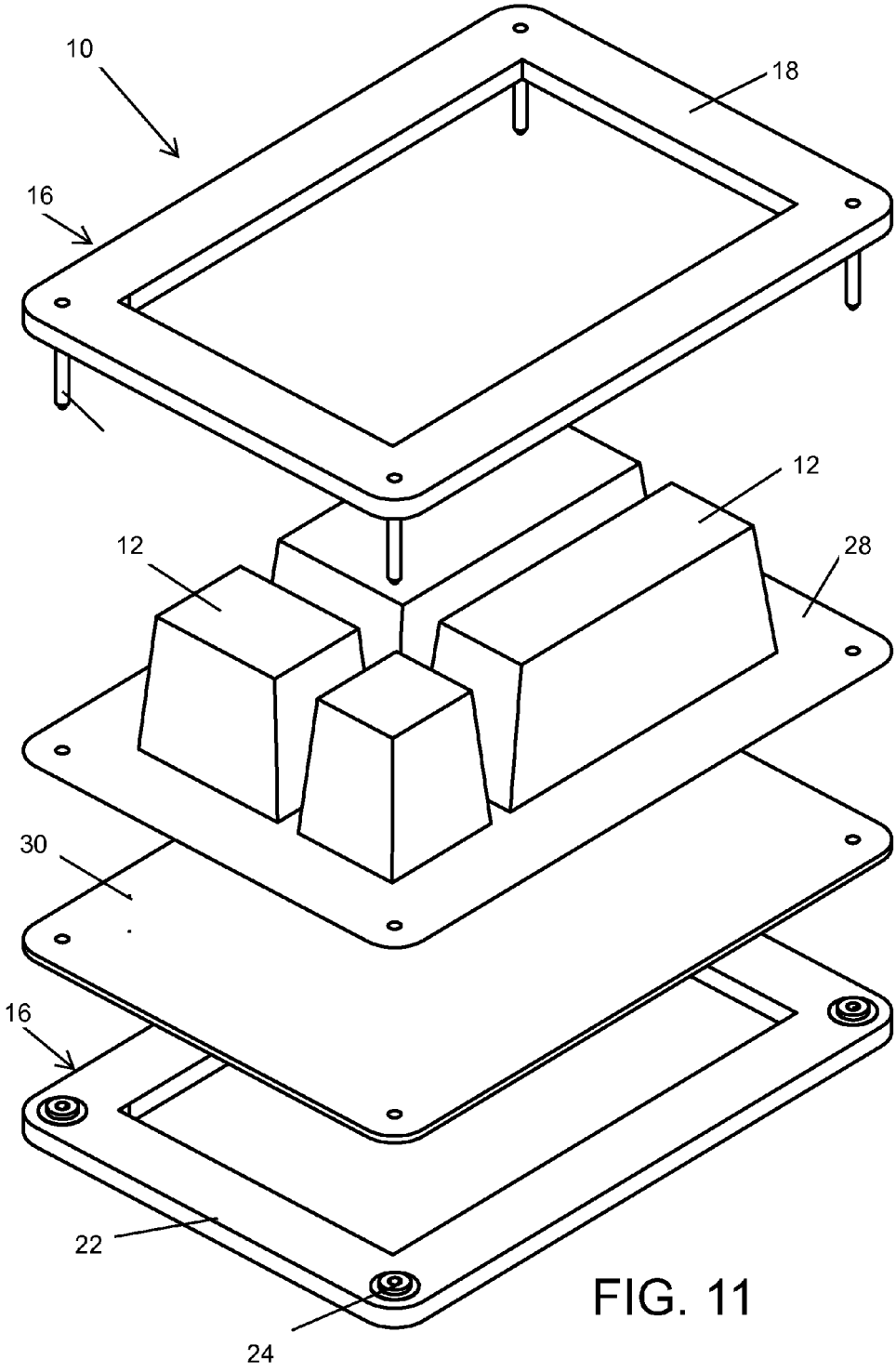
FIG. 11 is an exploded perview view similar to that shown in FIG. 10 but showing a first casing member having a plurality of cavities.

It should be appreciated that in embodiments of the invention comprising a first and second casing portion 28, 30, the cavity 12 of the casing 11 can be formed by one or both of the first and second casing portions 28, 30, as shown in FIG. 11. Further, the casing 11 may comprise a plurality of cavities 12, for instance when the product is a kit of components, allowing a consumer to verify that all components are present in the kit before purchasing the product.

The casing 11 may be comprised of any material suitable for housing a product of interest, and may be comprised of a thermoforming plastic, for example one made from polyethylene terephthalate (PET). The use of a thermoforming plastic allows the casing 11 to be formed entirely of recycled material, which may result in cost and marketing advantages for retailers. In contrast the locking collar 16 may be made by injection molding. This allows the male locking mechanism 20 and female locking mechanism 24 to be attached during the molding process. It is contemplated that the casing 11 made from thermoforming may need to be changed more frequently than the locking collar 16 because it may be more easily scratched. It will be appreciated that one of the casing portions may be integrally attached to one of the locking collar portions and in that instance it may be more likely that the combined locking member and casing portion would be injection molded and then only one portion of the casing would be made by thermoforming. In this instance the thermoformed portion might be changed by time to time.

Figure 9:
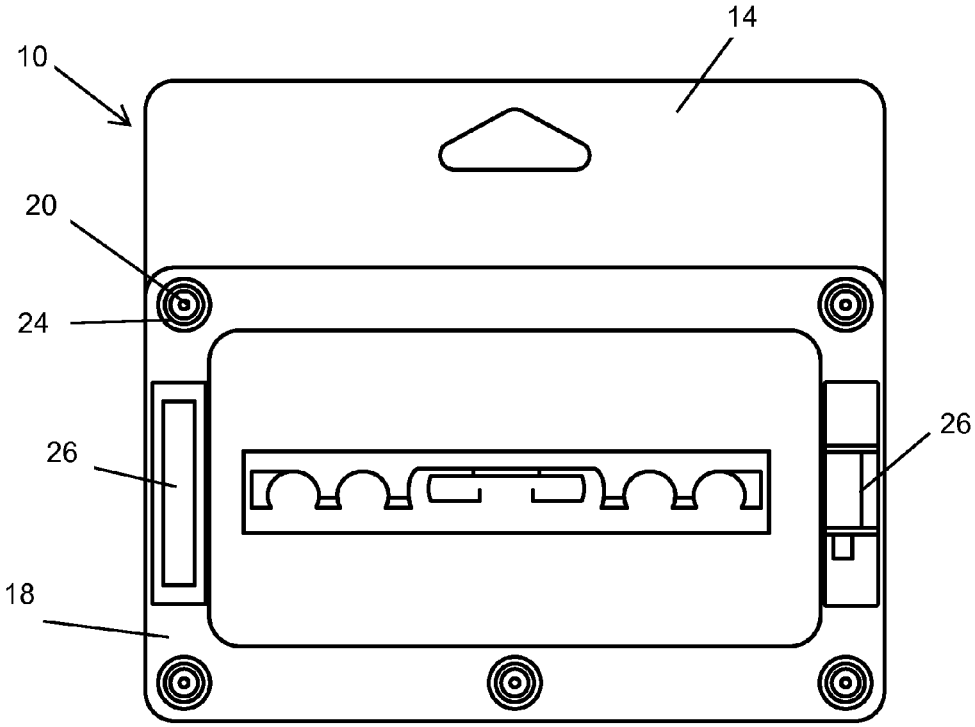
FIG. 9 is a frontal view of the second casing portion of a security package, with the second locking member integrally formed with the casing, showing a pattern of locking mechanisms on the second locking member.
Figure 10:
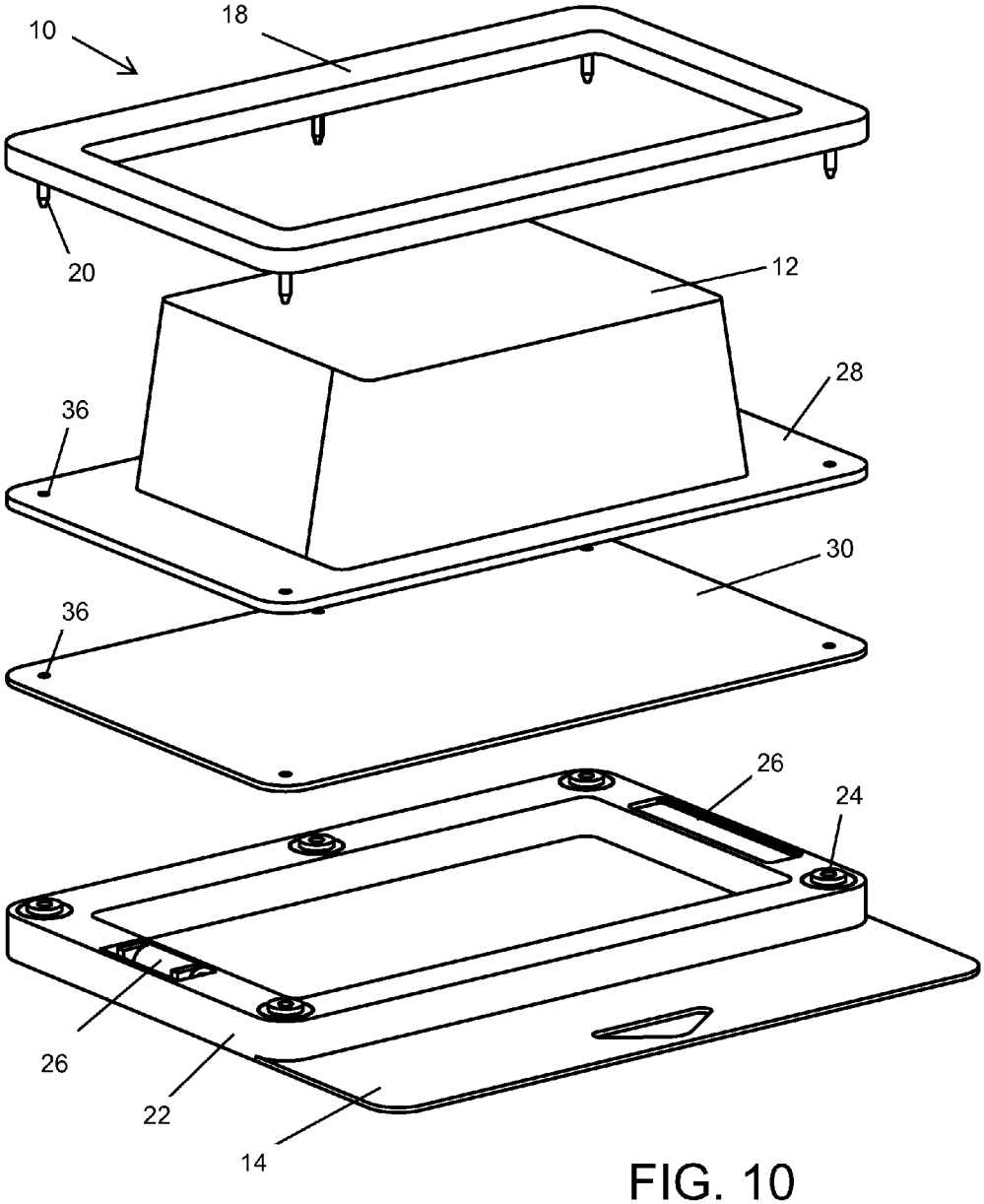
FIG. 10 is an exploded perspective view showing a first locking member, a first casing portion a second casing portion and a second locking member.

The collar 16 of the present invention is designed to hinder illicit attempts to release the locking mechanisms 20, 24 from one another. In at least one embodiment of the invention, the male and female locking mechanisms 20, 24 comprise one or a combination of magnetic and mechanical locking mechanisms. In a further embodiment, the at least one male and female locking mechanisms 20, 24 are a plurality of male and female locking mechanisms 20, 24 disposed in the collar 16 in a pattern, as shown in FIGS. 8 and 9. The plurality of locking mechanisms 20, 24 must be released simultaneously to unlock the security package, which serves to make unlocking the device very difficult without the corresponding release tool 34. In some embodiments of the invention, the first and second locking members 18, 22 are formed from an opaque material, and the first and second locking members 18, 22 substantially envelope the male and female locking mechanisms 20, 24 when the collar is in the locked configuration.

With the use of opaque material for the construction of the first and second locking members 18, 22, it is harder for a potential thief to know the positions of the male and female locking mechanisms 20, 24 and to illicitly unlock the collar 16 on the security package. Alternatively as shown in FIG. 8 the security package 10 may be transparent. A transparent security package has the advantage that it is easy to see the product inside.

Figure 13:
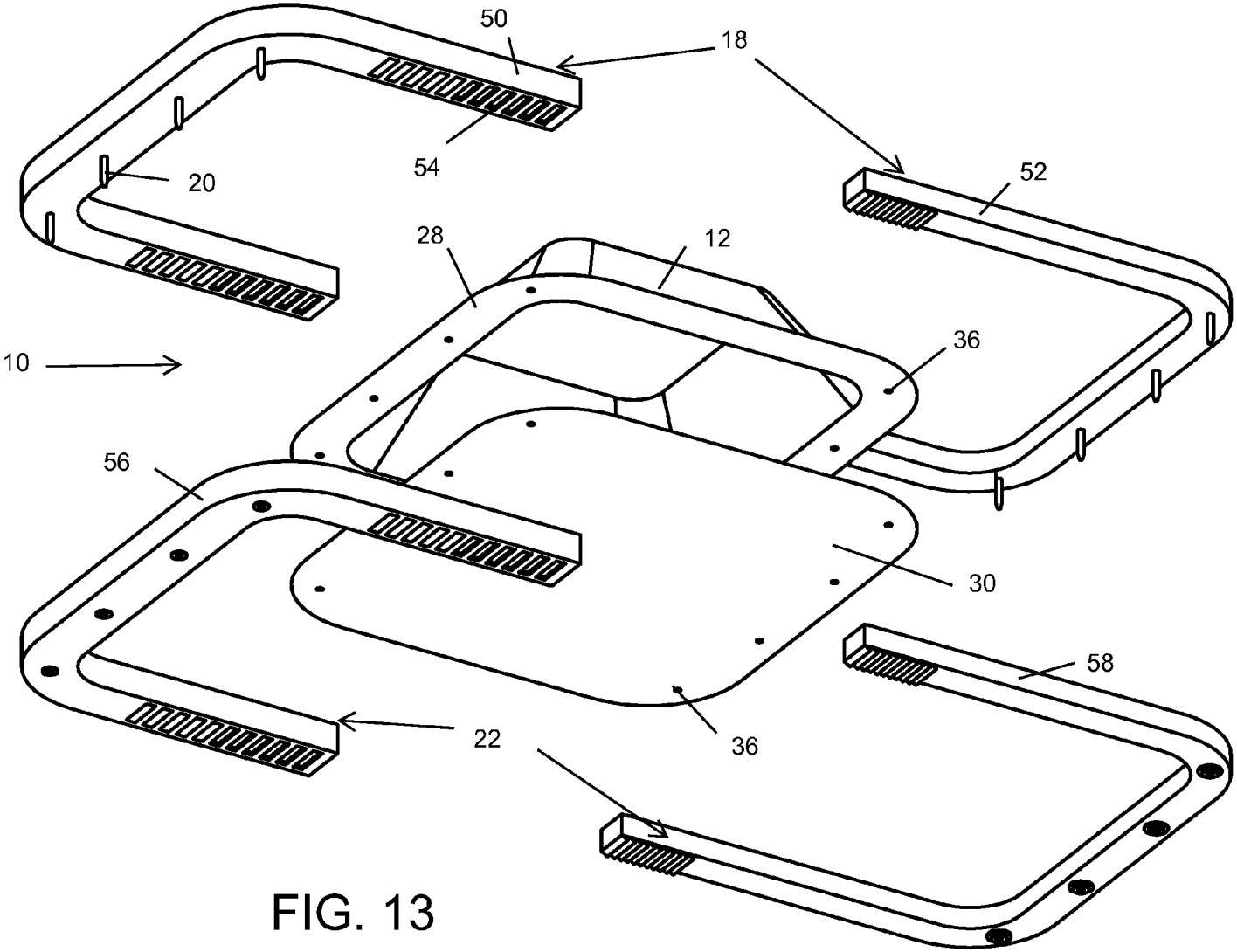
FIG. 13 is an exploded perspective view similar to that shown in FIG. 10 but showing an adjustable collar.

The collar 16 of the present invention may also be designed to hinder attempts to circumvent the locking mechanisms 20, 24 altogether. In an embodiment of the invention shown in FIG. 1, the collar 16 is shaped to form a perimeter around the cavity 12, such as when the cavity 1 is in the closed configuration and the collar 16 is in the locked configuration. However, it should be appreciated that in some embodiments of the invention, the collar 16 may not form a complete perimeter around the cavity 12. In another embodiment of the invention, the collar 16 further comprises a metal wire 15 as shown in FIGS. 5 and 7. The metal wire 15 may form a perimeter around the cavity as shown in FIG. 7 or a partial perimeter as shown in FIG. 5. In both instances the metal wire 15, hinders illicit attempts to cut through the collar 16. Further, the collar 16 of the present invention may be adjustable such that it may be used with differently shaped casings 11, as shown in FIG. 13. In one embodiment of the invention, the first and second locking members 18, 22 each comprise at least one dimension (either the width or the length) having an adjustable length. As an illustrative example, this may be accomplished through the use of a ratcheting mechanism in the first and second locking members 18, 22, wherein first locking member 18 includes first collar portion 50 and second collar portion 52 with a ratcheting mechanism 54 and second locking member 22 includes a first collar portion 56 and a second collar portion 58.

Figure 16:
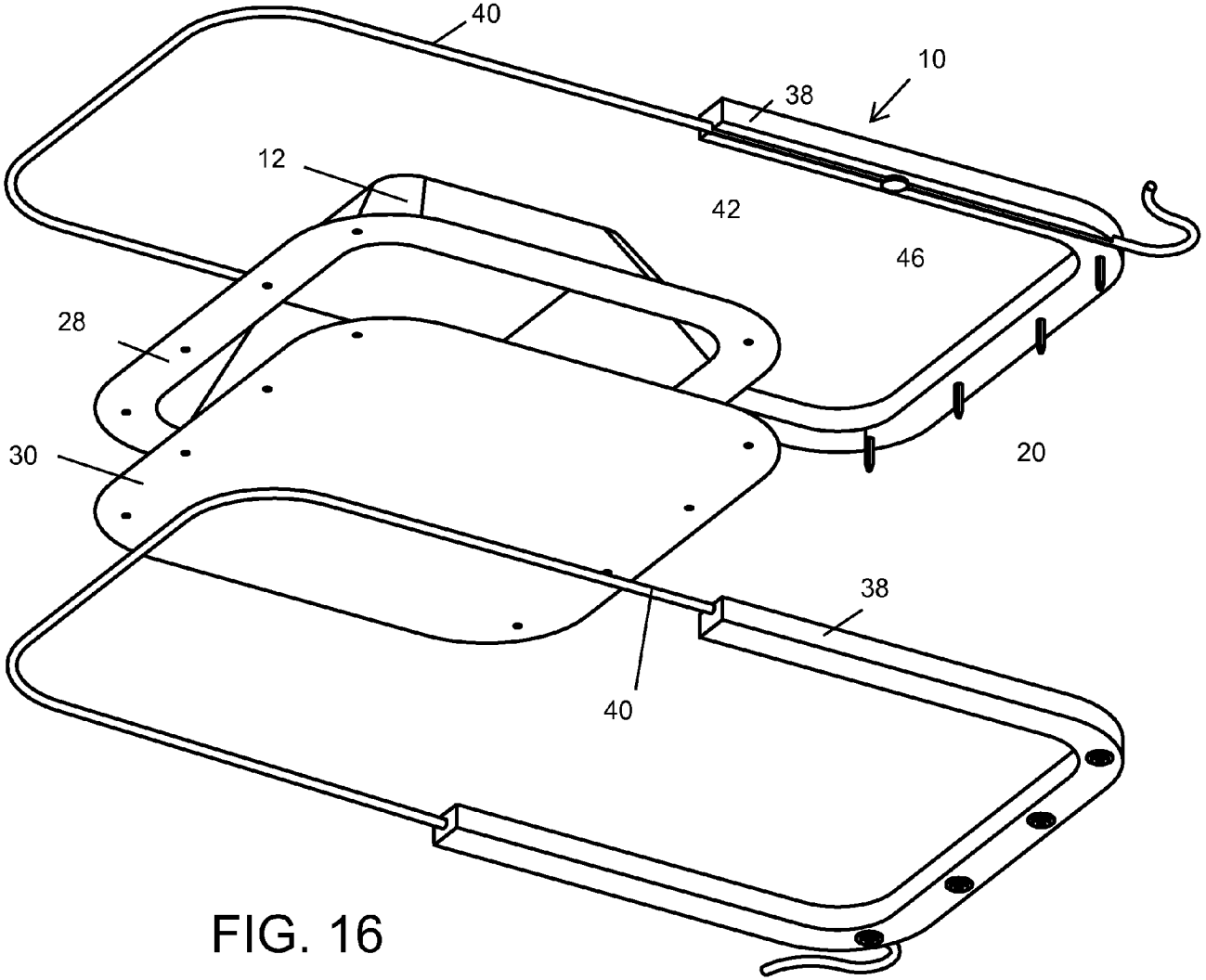
FIG. 16 is an exploded perspective view similar to that shown in 13 but showing a rigid portion and a flexible portion.
Figure 17:
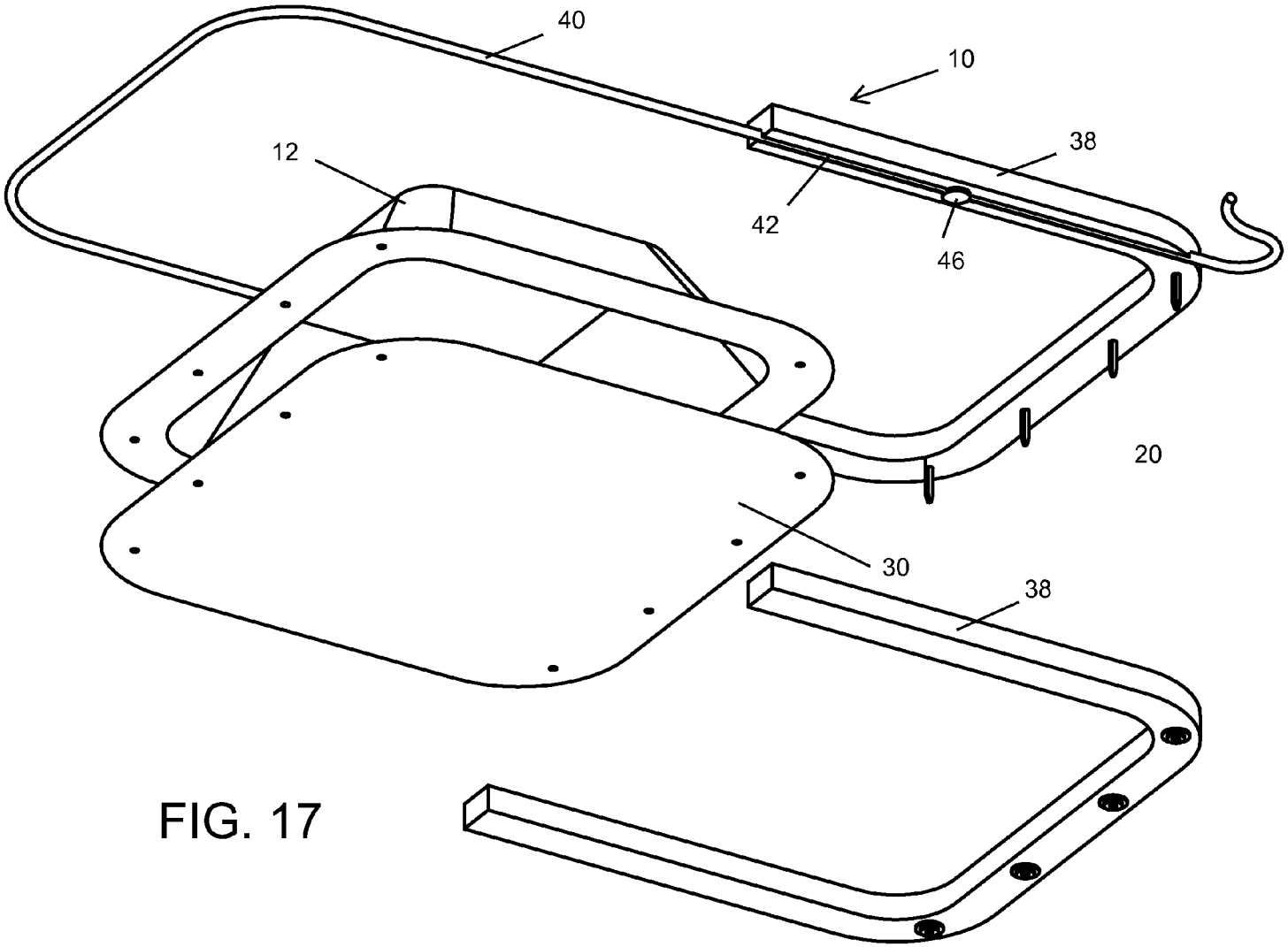
FIG. 17 is an exploded perspective view similar to that shown in FIG. 16 but showing only one flexible portion.

Referring to FIGS. 16 and 17, in another embodiment the collar 16 could include a rigid portion 38 and a flexible portion 40. The flexible portion 40 is constructed from material that is difficult to cut through for example wire cable. One end of the flexible portion 40 is securely attached to the rigid portion 38 and the other side of flexible portion is securable to the rigid portion 38 such that it can be secured at different locations along the length of the flexible portion. By way of example the rigid portion 38 has a channel 42 formed therein for receiving the flexible portion. The channel 42 has an opening formed therein accessible when the collar is in the open position but inaccessible when the collar is in the locked position. A lock 46 is positioned in the opening such that the flexible portion can be secured at different positions. It will be appreciated that one or two flexible portions 40 may be used as shown in FIGS. 17 and 16 respectively. It will be understood that the security package in this embodiment can be used to secure a wide variety of items of different shapes and sizes.

The collar 16 of the present invention may be formed of any material suitable for housing the male and female locking mechanisms 20, 24. Specifically the collar 16 may be formed from injection moulded plastic. This allows the male and female locking mechanisms 20, 24 to be embedded in the collar 16 during its construction.

Further, the security package of the present invention may comprise a different number of male and female locking mechanisms 20, 24. In embodiments where the male locking mechanism 20 comprises a protruding portion that extends from the first locking collar 18, the second collar 22 may have at least one non-locking slot 16 to accept these protruding portions without locking to them. In other words, a preselected number of the male locking mechanisms 20 are lockable to corresponding female locking mechanisms 24 in the second locking member 22, while remaining number of the male locking mechanisms 20 are insertable in at least one non-locking slot 16 in the second locking member 22. Thereby, one universal first or second locking member 18, 22 may be produced for many retailers with different corresponding first or second locking members 18, 22 for locking to a different number of the male or female locking mechanisms 20, 24 present depending on the level of security required for the merchandise sold. Alternatively there may be more female locking mechanisms 24 than male locking mechanisms 20.

The security package of the present invention may comprise at least one security device 26 which sets off an alarm when passed through security gates as best seen in FIG. 7. Specifically the security device 26 may be an RFID tag, an RF coil, RF Ferrite (8.2 Mhz, 3.25 Mhz, 4.8 Mhz, 58 Khz) an AM sensor, an electromagnetic sensor or a combination thereof. In some embodiments of the invention, the at least one security device 26 is included in the casing 11, in others the at least one security device 26 is included in the collar 16, and in others still the at least one security device 26 is included in both the collar 16 and the casing 11. The at least one security device 26 may be removable from the collar 16 when the collar 16 is in the unlocked configuration.

A larger RFID antenna is generally capable of being read at a further distance, which is a preferable feature in retail security packages. The collar 16 of the present invention provides a suitable location for the placement of a larger antenna than is typically possible, especially in embodiments of the invention where the collar 16 is shaped to form a perimeter around the cavity 12. In such embodiments, the antenna of the security device 26 may perform multiple functions: it may be both an antenna and a metal wire 15 for deterring attempts to cut the collar 16. An example of such an embodiment of the invention is shown in FIG. 7 With some types of security devices 26, an aluminum-lined bag may be able to stop the security device 26 from being read properly accounted for by the security system in place in a store. In such situations, an active security device 26 powered by a battery may be able to overcome the threat posed by these types of bag. The collar 16 or casing 11 of the present invention may be designed to house such a battery. In this case the retailer would be monitoring the active signals from the security devices. Once an active signal goes in active the monitoring device could alert the user because the security may be being shielded in aluminum-lined bag.

Figure 12:
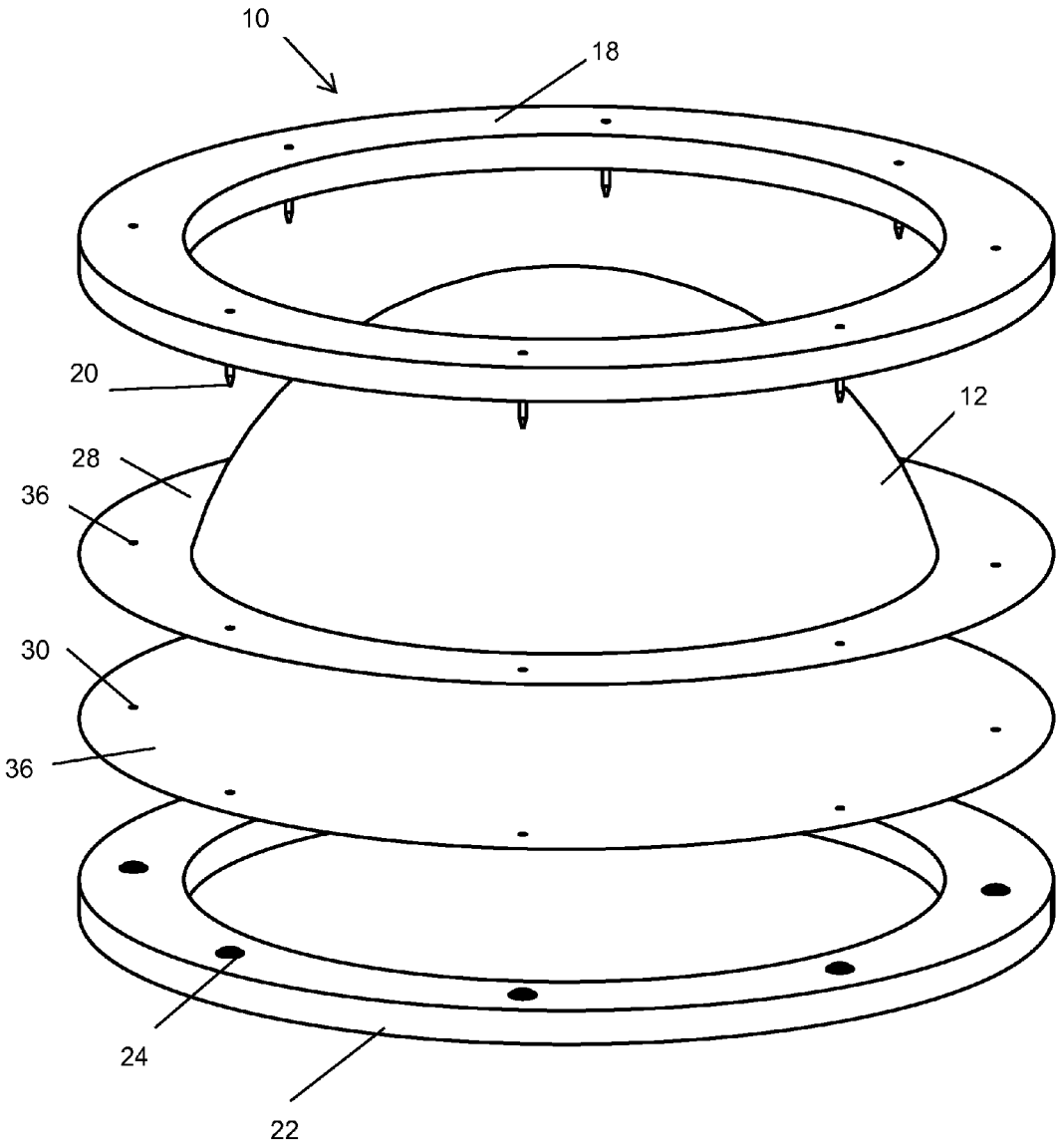
FIG. 12 is an exploded perspective view similar to that shown in FIG. 10 but showing a domed cavity.

It will be appreciated that a wide variety of shapes of cavities 12 may be used. By way of example only we have generally used box shapes, however other shapes could be used and as an example a dome shaped cavity is shown in FIG. 12.

Figure 14:
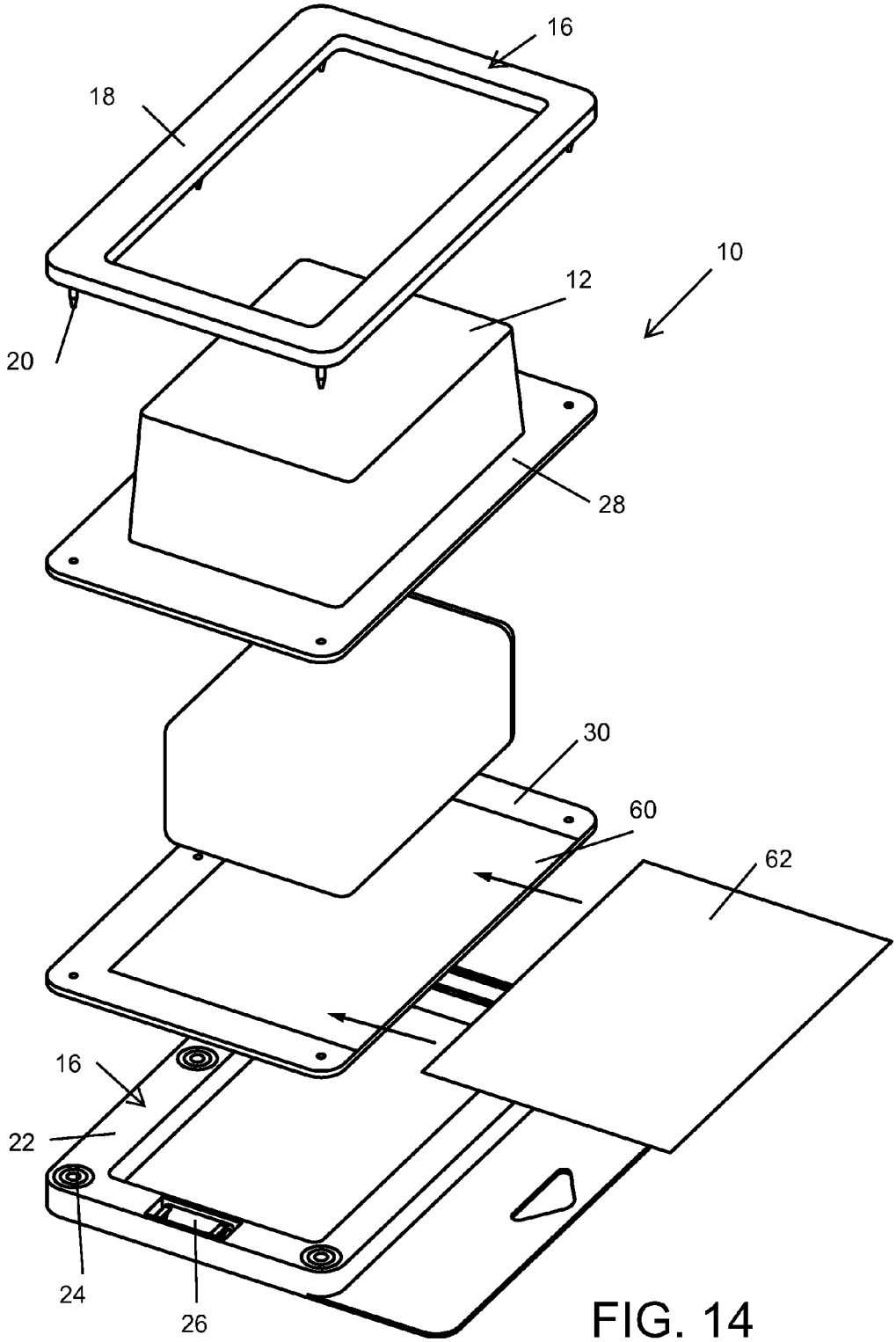
FIG. 14 is an exploded perspective view similar to that shown in FIG. 10 but showing a second casing member with a pocket for receiving printed material.
Figure 15:
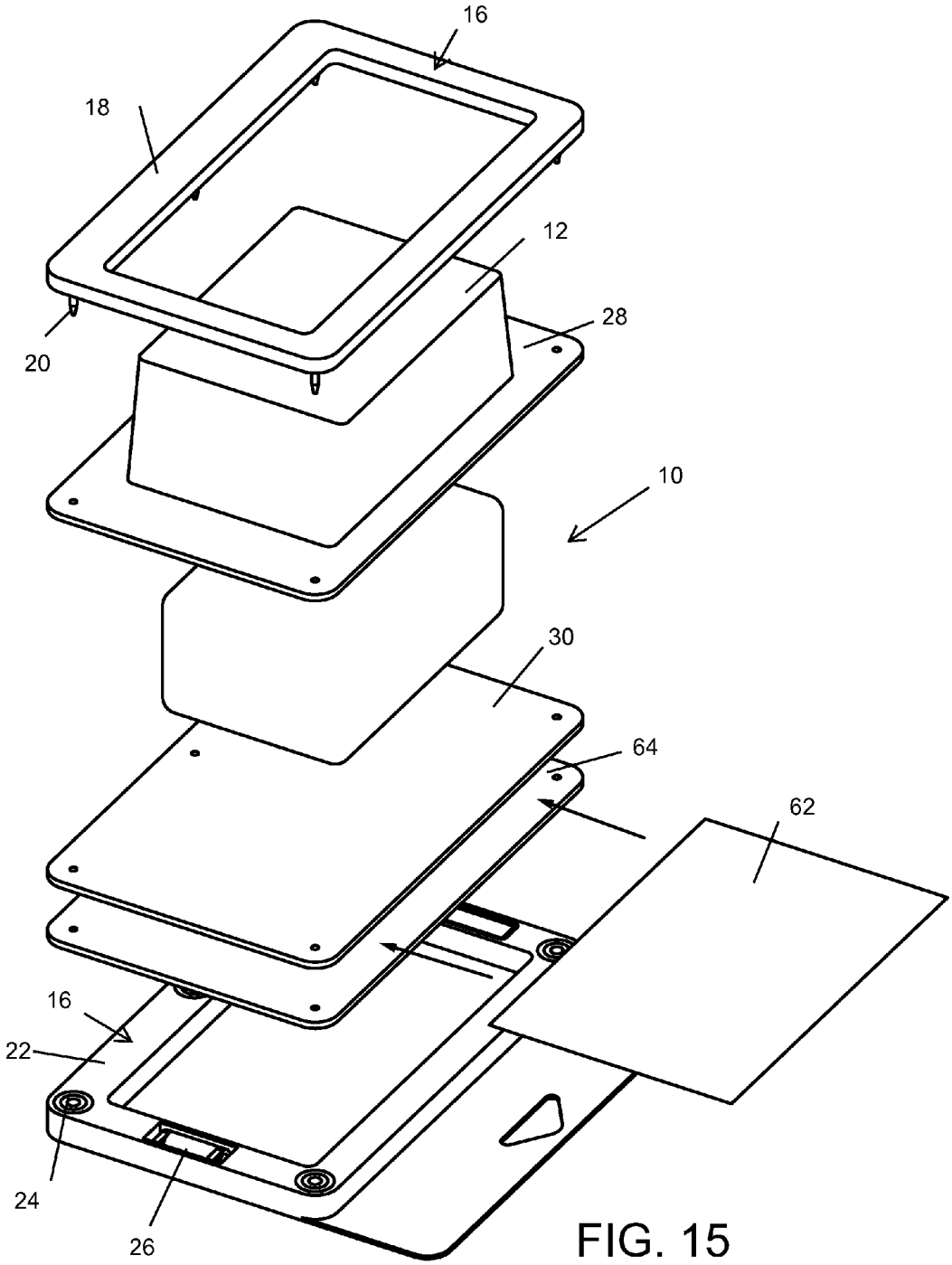
FIG. 15 is an exploded perspective view similar to that shown in FIG. 14 but showing a third casing portion.

Further it will be appreciated that the embodiments of the security package shown herein by be used as way of reducing packaging. However, some consumers, manufacturers or retailers might need to have printed material associated with the product. This may be provided to the consumer when the product is purchased and the packaging is left with the retailer. In this instance it may be desirable to provide a product information portions. Referring to FIG. 14 a pocket 60 for receiving product information 62 is provided in second casing member 30. In another embodiment a third casing member 64 is provided and the product information would be between the second casing member 30 and the third casing member 64 as shown in FIG. 15.

It will be appreciated that a wide variety of different locks may be used as the at least one male and female locking mechanism. The locking mechanisms may be a spring lock or a magnetic lock. By way of example only the male and female locking mechanism may be spring lock disclosed in U.S. Pat. No. 5,426,419 issued to Nguyen et al. on Jun. 20, 1995; spring lock disclosed in U.S. Pat. No. 3,942,829 issued Mar. 9, 1976 to Humble et al., spring lock disclosed in U.S. Pat. No. 4,299, 870 issued Nov. 1, 1981 to Humble et al. or U.S. Pat. No. 4,603,453 issued Aug. 5, 1986 to Yokoyama all of which are incorporated herein by reference. Alternatively the locking mechanisms may be a combination spring and mechanical lock as disclosed in US patent application 2009/0139279 published Jun. 4, 2009 to Glen Walter Garner which is incorporated herein by reference. Further it will be appreciated that in the configurations that use a plurality of male and female locking mechanisms a different type of lock may be used in the plurality of locks so that different type of detacher need to be in registration with the specific lock so that all of the locks can be released simultaneously to release the device.

There are several advantages to using the security package of the present invention. First, the modular nature of the package allows parts to be reused and/or recycled independently of one another, resulting in cost reduction for retailers. For instance, a casing 11 designed for one product may be reused on that product repeatedly until that product is no longer sold or the casing 11 is damaged, at which point the casing 11 may be recycled while the collar 16 used with it may continue to be reused on different products' casings 11. Second, because the casing 11 substantially conforms to the product, the security package maintains the brand image of the product and the same number of units may be placed on the shelf, as if there were no security package enclosing the product. Third, any RFID or electronic article surveillance devices 26 may be reused, representing further cost reductions for retailers. In addition to the immediate cost reduction, retailers can also attract customers by marketing themselves as using only reusable, environmentally friendly merchandising. Further with the multilock configurations different stores may have different placement of the locking mechanism thus making it possible for adjacent stores requiring different releasers.

What is claimed as the invention is:

1. A security package for a product and for use with a release tool, the security package comprising:

a casing having an open and a closed configuration and comprising at least one cavity shaped to receive the product; and a collar having a locked and an unlocked configuration, in the locked configuration the collar secures the casing in the closed configuration, the collar has a first locking member defining a plane having a plurality of male locking mechanisms extending outwardly from the plane of the first locking member, and a second locking member having a plurality of female locking mechanisms lockable to the male locking mechanisms, the first and second locking members are arranged wherein one is above the casing and the other is below the casing and in the closed and locked configuration the casing is sandwiched therebetween, the male and female locking mechanisms are one of a spring lock, a magnetic lock and a combination thereof and wherein the collar transitions from the locked configuration to the unlocked configuration only when all of the locking mechanisms are unlocked simultaneously with the release tool having a plurality of detachers in registration with the plurality of locking mechanisms.

2. The security package according to claim 1 wherein the casing further includes a first casing portion, a second casing portion, and wherein the cavity is formed by one or both of the first and second casing portions.

3. The security package according to claim 2 wherein the casing further includes a connector connected between the first and second casing portions.

4. The security package according to claim 3 wherein the connector comprises a strip of foldable material, and the first casing portion, the second casing portion and the connector are made of one continuous piece of material.

5. The security package according to claim 4 wherein the casing comprises at least one hole shaped to allow a portion of the at least one male locking mechanism therethrough.

6. The security package according to claim 4 wherein the one continuous piece of material is formed from thermoforming plastic.

7. The security package according to claim 1 wherein the casing further comprises a first casing portion, and a second casing portion, wherein the second casing portion is integrally formed with one of the first and second locking members.

8. The security package according to claim 1 wherein the casing further comprises a first casing portion, and a second casing portion, wherein the first casing portion is integrally formed with the first locking member, and the second casing portion is integrally formed with the second locking member.

9. The security package according to claim 1 wherein the collar is shaped to form a perimeter around the cavity.

10. The security package according to claim 1 wherein the first and second locking members are formed from an opaque material, and wherein the first and second locking members substantially envelope the plurality of male locking mechanisms and the plurality of female locking mechanisms when the collar is in the locked configuration.

11. The security package according to claim 9 wherein the collar further comprises a metal wire.

12. The security package according to claim 11 wherein the metal wire forms a perimeter around the cavity.

13. The security package according to claim 11 wherein the collar further comprises at least one electronic security device, and wherein the metal wire forms an antenna of the at least one electronic security device.

14. The security package according to claim 9 wherein the first and second locking members each comprise at least one member having an adjustable length.

15. The security package according to claim 9 wherein a preselected number of the plurality of male locking mechanisms are lockable to corresponding female locking mechanisms in the second locking member, and the remaining number of the plurality of male locking mechanisms are insertable in at least one non-locking slot in the second locking member.

16. The security package according to claim 9 wherein a preselected number of the plurality of female locking mechanisms are lockable to corresponding male locking mechanisms, and the remaining number of the plurality of female locking mechanisms are dummy female locking mechanisms.

17. The security package according to claim 1 wherein the collar further comprises at least one electronic security device.

18. The security package according to claim 17 wherein the at least one electronic security device is removable from the collar when the collar is in the unlocked configuration.

19. The security package according to claim 18 wherein the at least one electronic security device is one or a combination of RFID device and electronic article surveillance device.

20. The security package according to claim 18 wherein the at least one electronic security device is an active security device powered by a battery.

21. The security package according to claim 9 further including at least one electronic security device which is one or a combination of RFID device and electronic article surveillance device.

22. The security package of claim 1 wherein the collar is adjustable in size.

23. The security package of claim 1 wherein the product has a plurality of pieces and wherein the at least one cavity is a plurality of cavities shaped to receive the plurality of pieces of the product.

24. The security package of claim 2 wherein the casing has a product information portion configured to receive product information.

25. The security package of claim 24 wherein the product information portion is a pocket.

26. The security package of claim 24 wherein the casing further includes a third casing portion and the second and the third casing portion have and open and closed configuration and in the closed configuration are the product information portion.

27. The security package of claim 1 wherein the collar forms a perimeter around the cavity and the collar includes a rigid portion and at least one flexible portion.

28. The security package of claim 27 wherein the collar includes two flexible portions.

29. The security packages of claim 27 wherein the flexible portion is a wire.

30. The security package of claim 1 wherein the casing is provided by a manufacturer of the product and is intended to stay with the product.

31. A security package for a product and a product package having an open and a closed configuration and comprising at least one cavity shaped to receive the product, the security package for use with a release tool, the security package comprising a collar having a locked and an unlocked configuration, in the locked configuration the collar secures the product package in the closed configuration, the collar has a first locking member defining a plane having a plurality of male locking mechanisms extending outwardly from the plane of the first locking member, and a second locking member having a plurality of female locking mechanisms lockable to the male locking mechanism, the first and second locking members are arranged wherein one is above the casing and the other is below the casing and in the closed and locked configuration the casing is sandwiched therebetween, the male and female locking mechanisms are one of a spring lock, a magnetic lock and a combination thereof and wherein the collar transitions from the locked configuration to the unlocked configuration only when all of the locking mechanisms are unlocked simultaneously with the release tool having a plurality of detachers in registration with the plurality of locking mechanisms.

* * * * *